United States Patent [19]

Lindberg

[11] Patent Number: 4,626,866

[45] Date of Patent: Dec. 2, 1986

[54] COLLAPSIBLE FOLDABLE AERIAL

[75] Inventor: Torsten G. Lindberg, öckerö , Sweden

[73] Assignee: Telefonaktiebolaget LM Ericsson, Stockholm, Sweden

[21] Appl. No.: 733,143

[22] Filed: May 10, 1985

[30] Foreign Application Priority Data

May 30, 1984 [SE] Sweden ..... 8402951

[51] Int. Cl.[4] ..... H01Q 1/08

[52] U.S. Cl. ..... 343/880; 343/713; 343/882

[58] Field of Search ..... 343/880, 881, 882, 915, 343/888, 713

[56] References Cited

U.S. PATENT DOCUMENTS

| | | | |
|---|---|---|---|
| 2,673,295 | 3/1954 | Wentworth | 343/818 X |
| 3,541,566 | 11/1970 | Riebsamen | 343/915 X |
| 3,725,945 | 4/1973 | Lockwood | 343/882 |
| 3,745,581 | 7/1973 | Lockwood | 343/882 X |
| 3,860,932 | 1/1975 | Hochbrueckner | 343/717 |
| 4,471,360 | 9/1984 | Cotterman et al. | 343/880 X |
| 4,564,844 | 1/1986 | Bowering | 343/881 |

*Primary Examiner*—Daniel M. Yasich

*Attorney, Agent, or Firm*—Roberts, Spiecens & Cohen

[57] ABSTRACT

Collapsible aerial including bar-like base structure with aerial rods (2) rigidly attached thereto. The base structure comprises bars (1) which are connected in pairs to each other by a longitudinal joint (5), the bars associated with different pairs (3,4) being connected by transverse joints (6). In the operational position of the aerial the pivotal axes of the longitudinal joints (5) coincide, and the transverse joints (6) have separate pivotal axes. When a locking device (7) is released, the aerial rods (2) may be pivoted about the longitudinal joints (5) into a partially collapsed position, with the aerial rods on one side of the structure. The pivotal axes of the transverse hinges (6) then coincide so that the aerial rods can be swung about these axes to an entirely collapsed position in which the aerial rods (2) on the different bar pairs (3,4) cross over each other.

5 Claims, 8 Drawing Figures

COLLAPSIBLE FOLDABLE AERIAL

FIELD OF THE INVENTION

The invention relates to a collapsible aerial including a bar-like base structure with rigidly attached aerial rods.

BACKGROUND

Aerials including a base structure with antenna rods are voluminous and easily damaged. It is a desire that such aerials in mobile radio stations, for example, can be collapsible so as to avoid damage to the aerials during transport. Rapid collapsibility should be possible for military applications and the like. Collapsible aerials are known in which the aerial rods are attached to the base structure by screwed joints or by sleeves on the structure into which the rods may be inserted. The base structure can also be put together from parts in a similar way. Such aerials have small dimensions in their collapsed state, but they have many loose parts which can easily be lost. Work with the aerials is time-consuming and can be made more difficult by darkness, dirt and ice. Other known aerials are provided with joints enabling them to be collapsed, these joints being locked by screws or spring-actuated latches. Such aerials, which have a small number of joints, are often of large size and are also difficult to transport in their collapsed state. Aerials with a large number of joints have small overall dimensions in their collapsed state, but they are not robust and they wear rapidly. This wear may result in severe deterioration of the latching function, with the result that the aerials are collapsed by strong winds, for example, and are damaged. The articulated aerials are also time-consuming to handle, especially if the joints have loose parts for locking the joints.

SUMMARY OF THE INVENTION

The problems mentioned above are solved in accordance with the invention by the provision of an aerial having great mechanical stability, which can be collapsed by folding at a few hinge joints, so that its exterior dimensions are considerably reduced. The invention is characterized by a construction comprising a bar-like base structure with rigidly attached aerial rods and including a plurality of bars arranged in plural pairs side by side, the bars in each pair being connected to each other by a longitudinal hinge having a longitudinal pivotal axis while the bars in adjacent pairs are connected to each other by transverse hinges at adjoining ends of the bars. The longitudinal pivotal axes of the longitudinal hinges are coincident in an operational position of the aerial and the transverse hinges between the bars of adjacent bar pairs are on opposite sides of the base structure so that the bars may be pivoted about the longitudinal hinges from the operational position to a partially collapsed position in which the rods are on one side of the base structure and the rod pairs can be pivoted about the transverse pivotal axes of the transverse hinges into an entirely collapsed position.

In the partially collapsed position, the transverse pivotal axes of the transverse hinges are coincident which enables the aerial rods to travel to the entirely collapsed position.

BRIEF DESCRIPTION OF THE FIGURES OF THE DRAWING

An embodiment of the invention will now be described in detail with reference to the accompanying drawing, wherein.

DETAILED DESCRIPTION OF A BEST MODE FOR CARRYING OUT THE INVENTION

Figure 1:
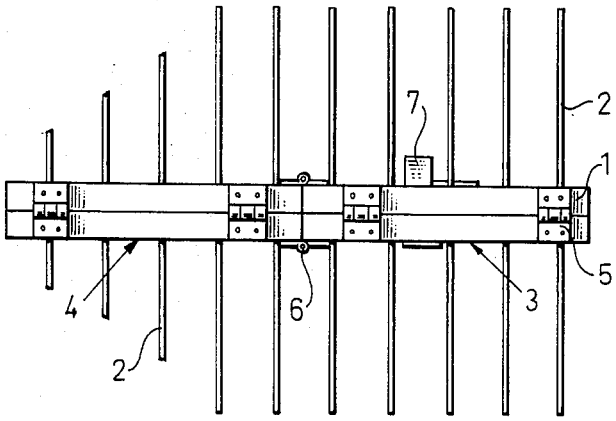
FIG. 1 is a plan view of an aerial in its operational state.
Figure 2:
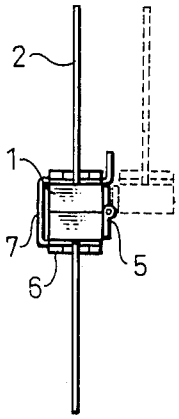
FIG. 2 is an end view of the aerial in its operational state, and in a partially collapsed state indicated by dashed lines.
Figure 3:
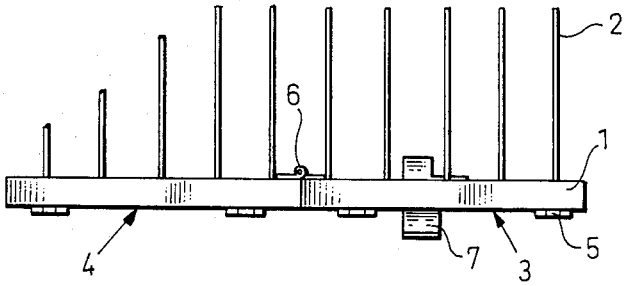
FIG. 3 is a plan view of the aerial in a partially collapsed state.
Figure 4:
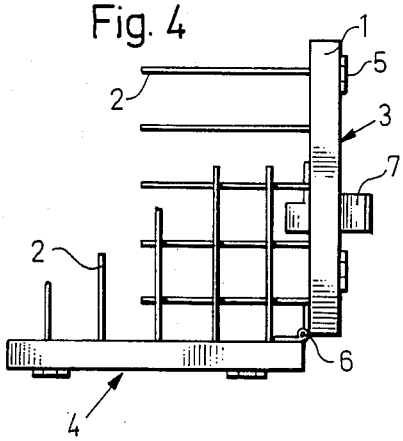
FIG. 4 is a plan view of the aerial in an entirely collapsed state.

In FIG. 1 there is seen an aerial with a bar-like base structure in accordance having the invention in its operational state and aerial rods 2 rigidly attached to the base structure. The base structure comprises four bars 1 arranged side by side in respective pairs 3 and 4. the illustrated embodiment, the bars have a rectangular cross section. Bars in the same pair are connected to each other via hinges 5 having pivotal axes in the longitudinal direction of the bar pair, so that a longitudinal hinge is formed. The bars in the two different bar pairs 3 and 4 are connected to each other via hinges 6 at the respective ends of the bars. In the illustrated operational state, the hinges 5 in the two bar pairs all are coincident and have the same pivotal axis, while the hinges 6 are mounted on the sides of the base structure facing away from each other and have parallel pivotal axis. An end view of the aerial illustrated in FIG. 1 in its operational state is illustrated in FIG. 2, where it will be seen that the aerial rods 2 are disposed in a common plane. The aerial is kept in its operational position by a known type of latching means 7 described below in connection with FIG. 6. The latching means 7 keeps the bar pairs 4 and 5 in the illustrated position and prevents the bars with the aerial rods pivoting pivoting about the hinges 5. Pivoting of the bar pairs about the hinges 6 is prevented by positioning these hinges on opposite outer sides of the base structure. When the locking device 7 is relased, the aerial rods can be pivoted about the hinges 5 from the operational position to a partially collapsed position as illustrated in FIG. 3 and as indicated in dashed lines in FIG. 2. The pivotal axes for the hinges 5 in the two bar pairs 3 and 4 also coincide in this position, with the aerial rods situated on one side of the base structure in two parallel planes. In this partially collapsed state, the hinges 6 have coincident pivotal axis, enabling the aerial rods to be pivoted at these hinges from the partially collapsed state to a completely collapsed state as illustrated in FIG. 4. In this state pivoting about the hinges 5 is prevented by the hinge 6.

The aerial rods can cross over each other, as illustrated in FIG. 4, by the rods being elastically deflected laterally. This elastic deflection can be avoided, of course, if the aerial rods on one bar pair are somewhat laterally displaced in relation to those on the other bar pair. In the illustrated embodiment, the base structure of the aerial only has one transverse joint at the hinge 6, but this structure can naturally have more than one transverse joint.

Figure 5:
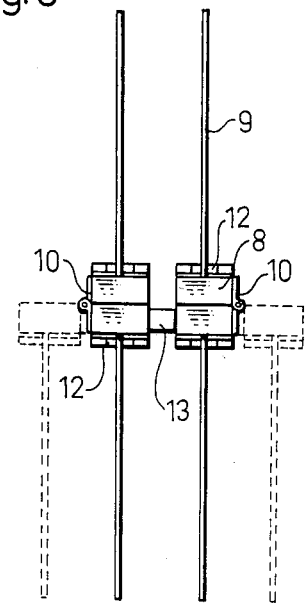
FIG. 5 is an end view of a further embodiment of an aerial in accordance with the invention.

A further embodiment of an aerial in accordance with the invention is illustrated in FIG. 5. The aerial, having a very wide bandwidth in this embodiment is illustrated in its operational state in end view in FIG. 5. This base structure comprises two halves, each of which is made up in the same way as the base structure in the embodiment described above. Bars 8 with aerial rods 9 are connected to each other by a hinge 10 to form bar pairs, each with its longitudinal hinge. At their ends, the bar pairs are joined to other bar pairs, concealed in the Figure, by hinges 12 which have transverse pivotal axes. Both halves of the base structure in the embodiment are assembled in parallel relation by transverse joining elements 13 of insulating material, and the longitudinal hinges 10 of the bar pairs are situated along two separate parallel lines in the longitudinal direction of the structure. The aerial rods can, in the same way as described above, be pivoted at the hinges 10 from the operational state to a partially collapsed state, indicated by dashed lines in FIG. 5. In this partially collapsed state the pivoting axes of the four hinges 12 coincide, enabling the aerial rods to pivot about them in to an entirely collapsed state, corresponding to that illustrated in FIG. 4.

Figure 6:
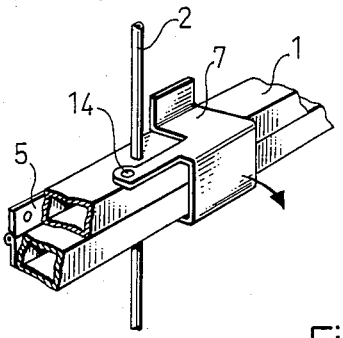
FIG. 6 illustrates a latching device for the aerial.
Figure 7:
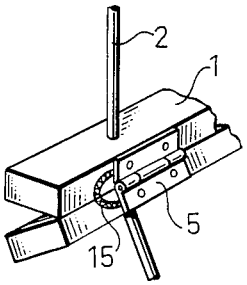
FIG. 7 illustrates an electrical connection between two parts in the base structure of the aerial and FIG. 8 illustrates a hinge for the aerial.

FIG. 6 illustrates the latching device 7 for keeping the aerial in FIG. 1 in its operational state. The latching device 7 has a U-shape and engages around the bars 1 on the side of the bar pair facing away from the hinges 5 for preventing the bars from pivoting about these hinges. The locking device is released by pivoting it about a hinge joint 14 in the direction illustrated by the arrow in Figure. It is essential for the function of the aerial that the rods on the different bars have good electrical connection with each other. FIG. 7 illustrates an example of such a connection, where a flexible electrical conductor 15 is fastened to the bars 1 in a manner known per se for their electrical connection. The conductor bridges over the deficient conductive capacity of the hinge 5.

Figure 8:
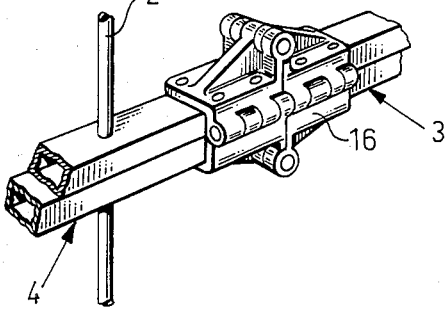

FIG. 8 illustrates a hinge 16, suitable for the purpose, a so-called combination hinge, which connects the respective bars in the pairs 3 or 4 to each other and also connects the two bar pairs to each other.

What is claimed is:

1. A collapsible aerial including a bar-like base structure with rigidly attached aerial rods, said base structure including a plurality of bars arranged in plural pairs side by side, the bars in each pair being connected to each other by a longitudinal hinge having a longitudinal pivotal axis, the bars associated with adjacent pairs being connected to each other by transverse hinges at adjoining ends of the bars, the longitudinal pivotal axes of the longitudinal hinges in an operational position of the aerial being coincident and the transverse hinges between the bars of adjacent bar pairs being on opposite sides of the base structure so that the bars with said associated aerial rods may be pivoted about said longitudinal hinges from the operational position to a partially collapsed position in which said aerial rods are on one side of the base structure and the rod pairs with said associated aerial rods can be pivoted about the transverse pivotal axes of the transverse hinges into an entirely collapsed position.

2. A collapsible aerial as claimed in claim 1 wherein the pivotal axes of the transverse hinges between two bar pairs in the operational position of the aerial are parallel.

3. A collapsible aerial assembly formed from two aerials as claimed in claim 1, where the longitudinal axes of the base structure of the two aerials are substantially parallel to each other in the operational position.

4. A collapsible aerial as claimed in claim 1 wherein said transverse pivotal axes of the transverse hinges are coincident in said partially collapsed position.

5. A collapsible aerial as claimed in claim 4 comprising hinged latching means for selectively locking the bars in said operational position.

* * * * *